US006912873B2

(12) United States Patent
Sanders

(10) Patent No.: US 6,912,873 B2
(45) Date of Patent: Jul. 5, 2005

(54) TRANSPORTABLE ICE MAKER

(76) Inventor: William T. Sanders, P.O. Box 1978, Myrtle Beach, SC (US) 29578-1978

( * ) Notice: Subject to any disclaimer, the term of this patent is extended or adjusted under 35 U.S.C. 154(b) by 0 days.

(21) Appl. No.: 10/621,182

(22) Filed: Jul. 16, 2003

(65) Prior Publication Data

US 2004/0083752 A1 May 6, 2004

Related U.S. Application Data

(62) Division of application No. 10/356,975, filed on Feb. 3, 2003, now Pat. No. 6,622,506.
(60) Provisional application No. 60/356,604, filed on Feb. 13, 2002.

(51) Int. Cl.[7] ..... F25C 1/00
(52) U.S. Cl. ..... 63/66; 62/389
(58) Field of Search ..... 62/389, 391, 239, 62/66, 340, 344, 423; 222/146.6, 413, 2, 113; 141/379, 391

(56) References Cited

U.S. PATENT DOCUMENTS

| | | | | | |
|---|---|---|---|---|---|
| 2,528,795 | A | | 11/1950 | Shontz | 52/105 |
| 3,807,193 | A | | 4/1974 | McKenney | 62/322 |
| 4,076,349 | A | | 2/1978 | Gettleman | 312/236 |
| 4,276,750 | A | * | 7/1981 | Kawasumi | 62/137 |
| D275,958 | S | | 10/1984 | Burns | D15/80 |
| 4,580,410 | A | | 4/1986 | Toya | 62/347 |
| 4,992,669 | A | | 2/1991 | Parmley | 290/1 R |
| 5,033,273 | A | * | 7/1991 | Buchser et al. | 62/344 |
| 5,125,237 | A | * | 6/1992 | Saia et al. | 62/239 |
| 5,230,448 | A | * | 7/1993 | Strohmeyer et al. | 222/643 |
| 5,272,888 | A | * | 12/1993 | Fisher et al. | 62/344 |
| 5,350,082 | A | * | 9/1994 | Kiriakides et al. | 221/1 |
| 5,454,625 | A | * | 10/1995 | Christensen et al. | 298/18 |
| 5,458,851 | A | | 10/1995 | Schroeder | 422/28 |
| 5,772,075 | A | | 6/1998 | Ash, Jr. | 222/1 |
| 5,775,111 | A | * | 7/1998 | Franklin | 62/74 |
| 5,947,342 | A | * | 9/1999 | Song | 222/413 |
| 6,089,420 | A | | 7/2000 | Rodriguez | 222/608 |
| 6,093,312 | A | | 7/2000 | Boulter | 210/86 |
| 6,266,945 | B1 | | 7/2001 | Schroeder | 53/473 |
| 6,289,684 | B1 | | 9/2001 | Guidry, II | 62/229 |
| 6,506,428 | B1 | * | 1/2003 | Berge et al. | 426/66 |

FOREIGN PATENT DOCUMENTS

EP 0995956 A2 * 4/2000

* cited by examiner

*Primary Examiner*—William Doerrler
*Assistant Examiner*—Mohammad M. Ali
(74) *Attorney, Agent, or Firm*—McNair Law Firm, P.A.

(57) ABSTRACT

A portable ice making unit including a housing adapted for stacking with cargo containers for land or sea transport. The housing is also capable of being to be attached to the bed of an over land transporter. The ice making unit may be 100% self contained requiring no on site water or electric power. The ice making unit may dispense ice on call or on cash demand.

9 Claims, 4 Drawing Sheets

TRANSPORTABLE ICE MAKER

CROSS REFERENCE TO RELATED APPLICATION

This application a divisional of application Ser. No. 10/356,975, filed Feb. 3, 2003 now U.S. Pat. No. 6,622,506 which claims priority of provisional applicaton Ser. No. 60/356,604, filed Feb. 13, 2002.

BACKGROUND OF TH INVENTION

This application claims priority of Provisional Application Ser. No. 60/356,604 filed on Feb. 13, 2002.

This invention is directed to an ice manufacturing unit which may be self-contained within a housing. The housing is constructed to be transportable by stacking with cargo containers and transported by rail, by sea or by truck and trailer or simply by being secured with and transported by one of the above transport means.

Transportable ice manufacturing units have long been known with several such units being illustrated in U.S. Pat. Nos. 2,528,795; 5,458,851; 4,992,669; and 6,289,684. These references primarily deal with bulk ice while none of them deal with the combined need of providing a self-contained ice making unit which functions to make and deliver ice to an individual on call.

Accordingly, it is an object of this invention to provide an ice making unit including a housing which is adaptable for transporting by land or sea carriers either singularly or in stacked condition with standard cargo containers.

Another object of the invention is an ice making unit which is completely housed with a portable housing unit.

Another object of the invention is a portable ice making unit which is completely self-contained.

Another object of the invention is an ice making unit which is partially contained.

Another object of the invention is a transportable ice making unit with a dispenser adapted for filling coolers and sacks.

Another object of the invention is an ice making unit which may operate while being transported or while stationary.

Another object of the invention is to eliminate the necessity to provide bulk ice shipments to isolated areas for later use.

SUMMARY OF THE INVENTION

The instant inventing is directed to a portable ice making unit which includes a portable housing carrying the ice making and dispensing equipment. The housing is preferably formed metal, is constructed to be 20 ft. or 40 ft. in length and about 8 ft. in height and width. The housing is divided into two compartments, an open compartment and an enclosed compartment. The housing is also provided with locking members at each corner which are operative to engage with the bed of a transport member or with a cargo container allowing the ice making unit to be transported in single level fashion or in stacked fashion. The ice making unit is constructed to be transported by land or sea transport.

The open compartment is formed with a floor and a frame to which is secured meshed wire such as chain link fence wiring. A door is located at a convenient point along an end or side.

Panel members may be provided which are of a size to cover the open end, top and side sections of the open compartment. These panel members may be attached to enclose the open compartment during transport. Once the ice making unit is in position, the panels are removed prior to ice being made.

The open compartment may house a fuel tank, a generator and a remote condenser. It also may house the exhaust of an air conditioning unit which controls the temperature within the control unit.

The enclosed compartment carries an ice machine, an ice dispenser and a pre-charged line set which interconnects with the condenser and the ice machine. A control panel and an air conditioner are also arranged within the enclosed compartment. Also, a water filter, a water pump and a water tank are provided.

It is understood that if the use site includes electrical power, the generator and fuel tank may be omitted. Also, if the site includes a water supply, the water tank and water pump may be omitted.

The housing includes an opening in the side panel through which the ice dispenser passes ice by way of an ice chute. The chute includes a chute extension which engages outside of the housing with the chute. The extension receives ice from the chute and directs it as desired. The chute extension is removable and is detached during transport of the ice making unit. A cover may be provided over the opening.

A dispensing panel may be connected with the housing side to receive ice from the ice dispenser. The dispensing panel includes a display panel and a dispensing section. The dispensing section includes a delivery chute and a tray arranged beneath the display panel. The tray is located at least 2 ft. beneath the delivery chute and will accommodate an ice chest. A bag dispenser is also provided.

An activating device including a money changer is carried on the face of the dispensing panel.

The ice making unit finds use at building sites, disaster areas, concert or convention areas and undeveloped areas. It is designed for easy transport and for long term use in a fixed area.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

Turning now to the drawings, FIGS. 1 and 3 show portable ice making unit 10 mounted with trailer 12 and parked in a desired location ready for use. Ice making unit 10 includes housing 14 which comprises open compartment 16 and enclosed compartment 18.

Figure 1:
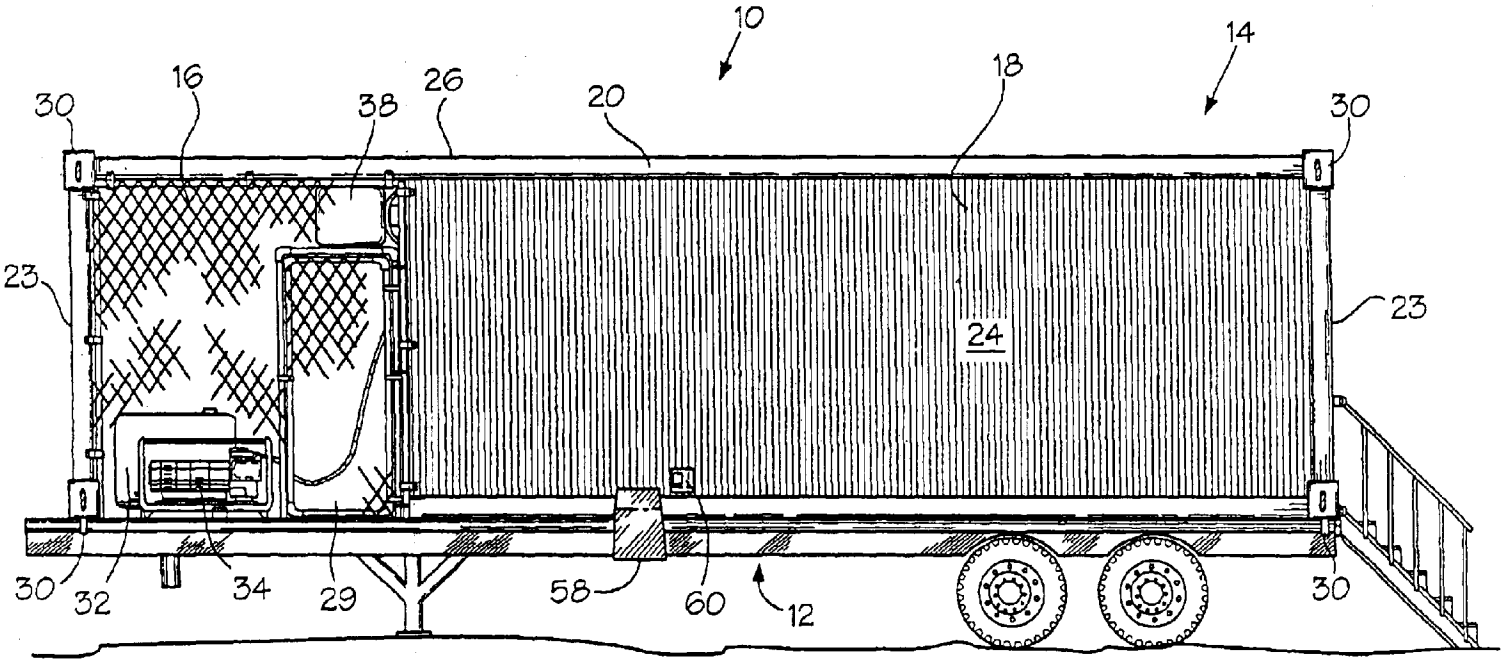
FIG. 1 is a side view of the portable ice making unit united with a trailer.

Housing 14 is constructed to be 20' or 40' long and about 8' in height and width. Preferably housing 18 is constructed of steel and with structural strength to be capable of supporting a multiple of its weight up to at least 100,000 lbs.

Horizontal and vertical members form truss 20 to which a plurality of panels are attached for forming floor 22, side walls 24 end walls 23, 23' and top 26. End wall 23 comprises a pair of panels 23A, 23B which are hinged to opposing sides 24. Panels 23 A, B may be swung open to allow placement of the components within enclosed compartment 18. Door 27 is formed in panel 23B of end wall 23 of normal access into the enclosed compartment.

Open compartment 16 is encased or caged along its sides, end and top by a wire mesh 28, such as chain link fence wire, and includes a door 29 for access. Door 29 is of a width which allows passage for all components within the open compartment.

Figure 1A:
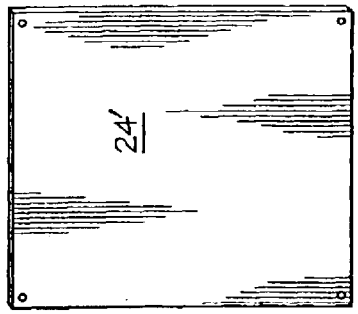
FIG. 1A is a side view of a detachable panel for attachment with the open compartment during transport.
Figure 2:
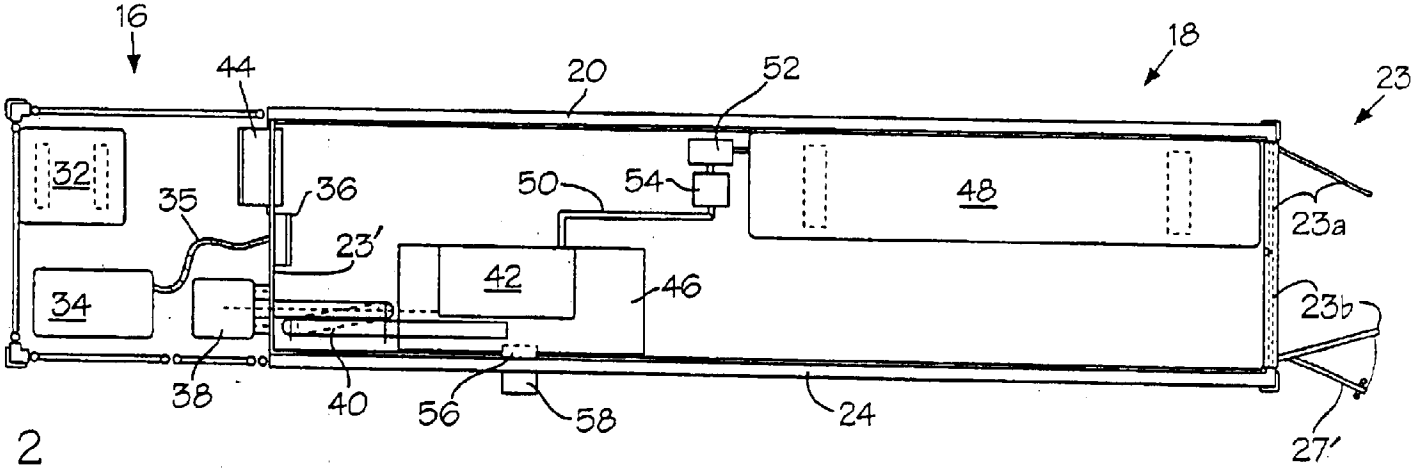
FIG. 2 is a cutaway top view of the ice making unit.
Figure 3:
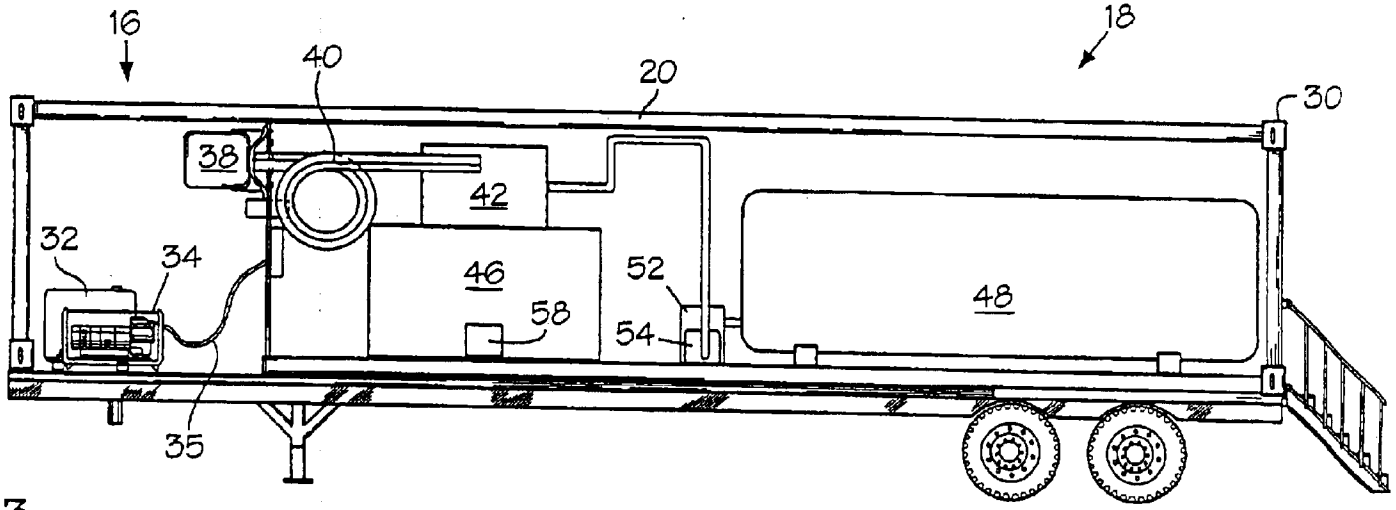
FIG. 3 is a side view of the ice making unit.

Panel members 24', shown in FIG. 1A, which are of a size substantially equal the open end, top and sides of open compartment 16 may be removably attached with truss 20 forming housing 14 to be completely enclosed during shipping, and particularly when shipping by sea. Panels 24' are removed once ice making unit 10 is positioned to make ice.

Each corner of truss 20 includes a latching unit 30, each of which is operative to engage with the bed of a land carrier such as trailer 12 or with a rail car bed. Latching units 30, which are standard with cargo containers, are also operative to engage housing 14 with cargo containers allowing housing 14 to be stacked with the cargo containers for sea and rail transport.

Mounted on floor 22 within open compartment 16 is a fuel tank 32, generally for diesel fuel, and a diesel driven generator 34.

Generator 34 is connected with control panel 36 by lead 35. Control panel 36 is mounted with end wall 23' within enclosed compartment 18.

Remote condenser 38 is also located in open compartment 16 and connects with pre-charged line 40 which passes through end wall 23' to connect with ice machine 42 within enclosed compartment 18.

The arrangement thus far described can function using electricity supplied by a utility. The electrical source would simply be connected with lead 35 in a usual manner. In this situation there would be no need for the entire open compartment 16 to be open. It may be desirable to provide solid panels around the lower half leaving only the upper half and top of compartment 16 open.

It is preferred that generator 30 have a capacity of between 8.5 kw to 80 kw, that fuel tank 32 have a capacity of between 5–150 gallons, and that remote condenser have a capacity of between 400–3800 lbs/day.

Enclosed compartment 18 includes electrical control panel 36 and pre-charged line 40 carried by end wall 23'. Also carried by end wall 23' is an air conditioning unit 44 with its exhaust being directed into open compartment 16 and with a capacity of between 5,000 and 15,000 btu for maintaining the temperature within the enclosed compartment at a desired level. Door 27' provides easy access.

Pre-charged line 40 connects with ice making machine 42 which is connected with ice dispenser 46. Water may be supplied by way of water tank 48, line 50, pump 52 and water filter 54.

In the event that water is available on the selected site, tank 48 and pump 52 may be eliminated. The on-site water could simply be connected with line 50, preferably behind filter 54.

An opening 56 is provided in side wall 24 adjacent to ice dispenser 46. Chute 58 is designed to pass through opening 56 and to be removably engaged in any suitable manner with the ice dispenser as shown. It is preferred that during transport chute 58 be disconnected from the ice dispenser and located within the enclosed compartment. Also, it is preferred that opening 56 be covered during transport.

An actuator 60, usually a button, is mounted in side wall 24 adjacent opening 56. Actuator connects with control panel 36 through circuitry. Control panel 36 through usual circuitry controls ice making machine 42, dispenser 46, panel 52 and air conditioner 44.

In use, transportable ice making unit 10 is moved to a desired area and disconnected from the transporting unit. In some instances, the housing of the ice making unit is set up on an on-site pad, in other instances the housing is left on the trailer as indicated in FIG. 1.

In position, ice making unit 10 functions to supply ice on demand through chute 58. Normally, a container is positioned below chute 58, actuator 60 is pressed which initiates through control 36 delivery of ice from ice dispenser 46 through the chute and into the container.

Figure 4:
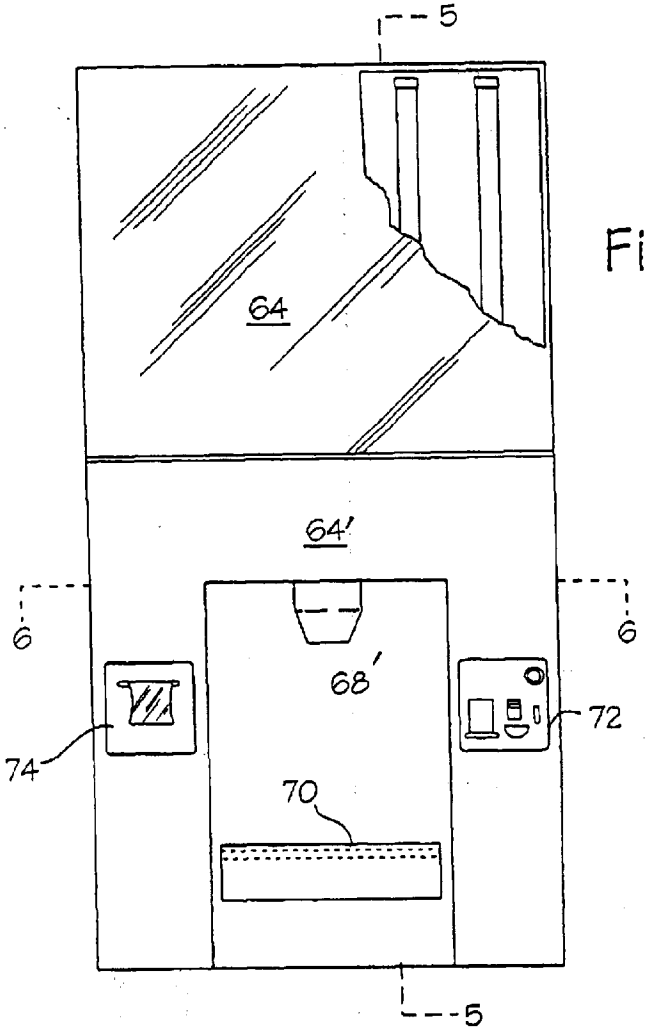
FIG. 4 is a front view of a dispensing panel for use with the ice dispensing unit.
Figure 6:
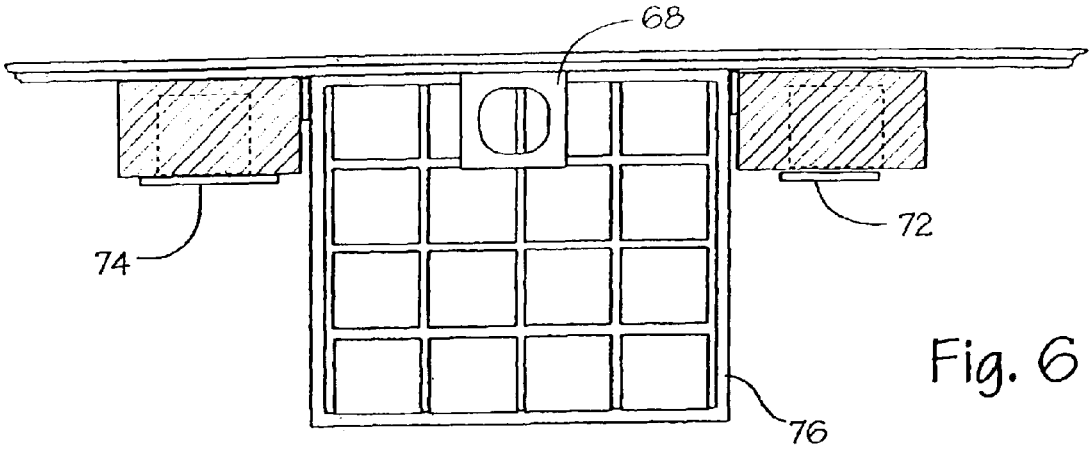
FIG. 6 is a cutaway top view along line 6—6 of FIG. 4.
Figure 7:
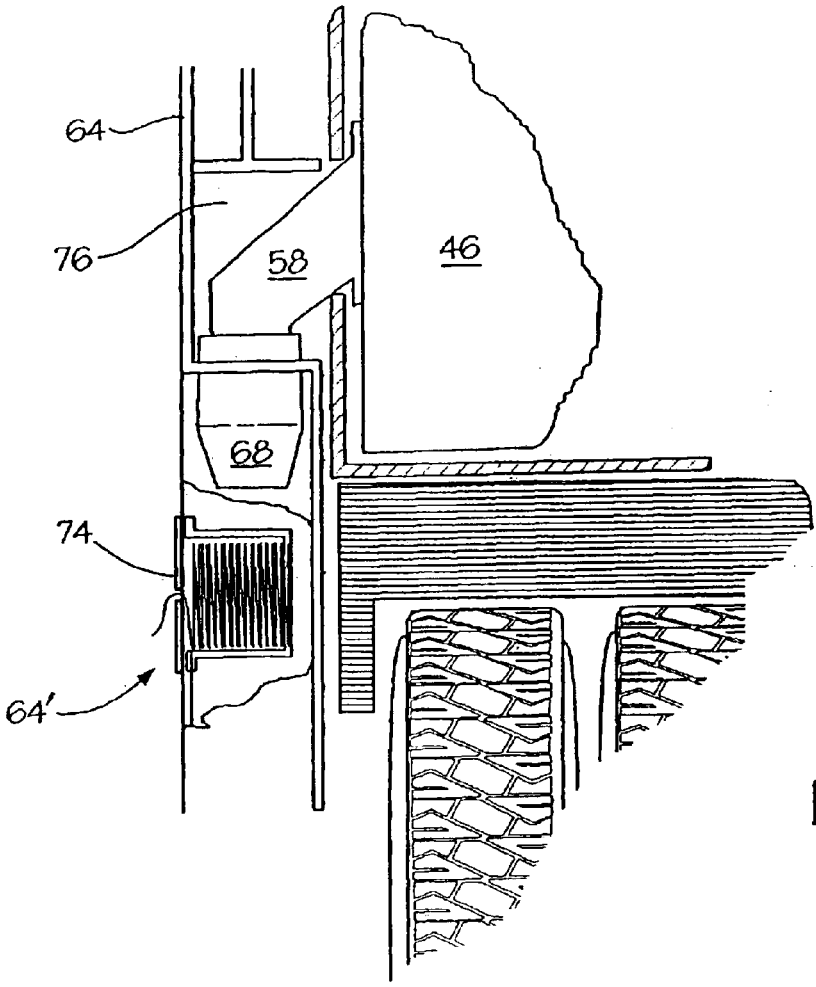
FIG. 7 is an exploded cutaway view similar to FIG. 5.

It is noted that all equipment described, remote condenser 38 ice machine 42, ice dispenser 46 are commercially available and function in their normal manner. It is preferred that the remote condenser has a capacity of between 400–3 m800 lbs/day, the ice machine a capacity of 4190–10, 000 lbs per day and the ice dispenser a capacity of between 450–2, 800 lbs. The water tank should have a capacity of between 320–1800 gallons is provided on one side of recess 66 while a bag dispenser 74 is provided on the opposite side of the recess. It is noted the bag dispenser may dispense bags from a roll as shown in FIG. 4 or bags from a package as shown in FIG. 6.

An alternative arrangement is shown in FIG. 4–7. A dispensing panel or display front 62 which includes a lighted display panel 64 and a delivery section 64'. Delivery section includes a recessed opening 66 which carries a delivery chute 68 with a support tray 70 arranged about 2' beneath the delivery chute. Tray 70 is designed and located to receive and support an ice chest in position beneath delivery chute 68 and in position to be filled with ice.

Figure 5:
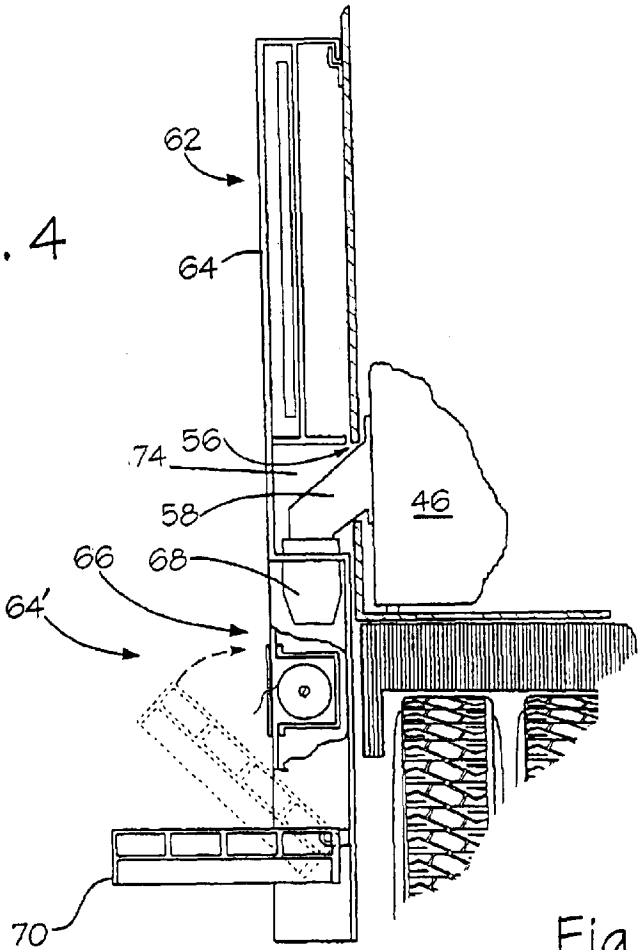
FIG. 5 is a cutaway side view along line 4—4 of FIG. 4.

Dispensing panel 62 is designed to be engaged with side wall 24 in position for chamber 76 to receive dispenser chute 58. Delivery chute 68 is designed to receive the delivery end of dispenser chute 58 as shown in FIG. 5.

An actuator 72 is connected in any convenient manner with control panel 36 and operates to actuate ice dispenser 46 to deliver a pre-set or set volume of ice through dispenser chute 58 to delivery chute 68.

An actuator 72 which may include a money changer, a money receptacle or receptor for receiving coins or bills and an actuating mechanism or start button is provided for actuating ice dispenser 46 to deliver ice through dispenser chutes 58 and delivery chute 68 when proper monies have been deposited.

Dispensing panel or display front 62 along with delivery chute 68 are designed to be disconnected from side wall 24 and secured with other enclosed housings containing ice making machines.

While a preferred embodiment of the invention has been described using specific terms, such description is for illustrative purposes only, and it is to be understood that changes and variations may be made without departing from the spirit or scope of the following claims.

What is claimed is:

1. An ice dispensing machine including:

a compartment including a compartment wall, said compartment containing an ice dispenser including a dispenser chute said compartment wall having an opening through which said dispenser chute is positioned;

a dispensing panel attached to said compartment wall and including a front with a display and a recess;

an ice delivery chute passing through said dispensing panel into said recess, said ice delivery chute being adapted to receive ice from said ice dispenser through said dispenser chute;

a shelf arranged beneath sold delivery chute, a distance sufficient to allow an ice chest or ice bag to be positioned beneath said ice delivery chute; and, an activating unit, including a money receptacle, for accepting money and activating said ice dispenser to deliver ice through said dispenser chute and said delivery chute into said ice chest or ice bag.

2. The panel of claim 1 wherein an upper end of said ice delivery chute is located within a chamber formed in said dispensing panel, said chamber receiving said upper end of said dispenser chute.

3. The panel of claim 1 wherein said dispensing panel includes a bag dispenser.

4. A method of producing and dispensing ice including:

providing a compartment which includes an ice maker end an ice dispenser with an ice dispensing chute;

providing a dispensing panel which includes a display front, a chamber which receives a delivery chute, an activating unit, and a shelf beneath said delivery chute;

connecting said dispensing panel with said compartment with said dispensing chute positioned within said chamber and received in said delivery chute;

providing an ice chest which is approximately 2' high and placing said ice chest on said shelf beneath said delivery chute;

actuating said actuating unit to cause said ice maker to make a designated set volume of ice and said dispensing machine to deliver said ice through said dispensing chute and said delivery chute into said ice chest and removing said ice chest.

5. An ice dispensing machine including a compartment having a side wall and a dispensing panel:

said compartment containing an ice making machine and an ice dispenser, said ice dispenser being adapted to receive, store and dispense ice;

said dispensing panel being attached to said side wall and having a display front, an actuator, a delivery chute, and a support tray positioned about 2 feet beneath said delivery chute;

said delivery chute being positioned to receive ice from said dispenser through a dispenser chute passing through said wall;

an actuator being operative to activate said dispenser to deliver a set volume of ice; whereby, clearance is provided to position an ice chest on said support tray to receive said pre-set volume of ice delivered from said dispenser through said dispenser chute and said delivery chute upon actuation of said actuator.

6. The ice dispensing machine of claim 5 wherein said actuator includes a bill receptor and changer.

7. The ice dispensing machine of claim 5 wherein said display front includes a recess in which said delivery chute is located within said recess.

8. The ice dispensing machine of claim 7 wherein said shelf is pivotally mounted within said receptor.

9. The ice dispensing machine of claim 5 wherein said dispensing panel includes a display panel above said delivery chute.

* * * * *